US010591215B1

(12) United States Patent
Fernandez

(10) Patent No.: US 10,591,215 B1
(45) Date of Patent: Mar. 17, 2020

(54) SKIM TOOL

(71) Applicant: Jose Antonio Fernandez, San Nicolas de los Garza (MX)

(72) Inventor: Jose Antonio Fernandez, San Nicolas de los Garza (MX)

( * ) Notice: Subject to any disclaimer, the term of this patent is extended or adjusted under 35 U.S.C. 154(b) by 49 days.

(21) Appl. No.: 16/010,170

(22) Filed: Jun. 15, 2018

Related U.S. Application Data

(60) Provisional application No. 62/520,950, filed on Jun. 16, 2017.

(51) Int. Cl.
*F27D 3/15* (2006.01)

(52) U.S. Cl.
CPC ..... *F27D 3/1563* (2013.01)

(58) Field of Classification Search
CPC ..... F27D 3/1563
USPC .... 266/228, 44, 161, 165, 143, 226; 75/582; 210/241
See application file for complete search history.

(56) References Cited

U.S. PATENT DOCUMENTS 1,827,503 A * 10/1931 Anderson ..... F27D 3/1563 266/287
5,051,180 A * 9/1991 Williams ..... B22D 43/007 210/241
6,464,929 B1 * 10/2002 Groteke ..... C21C 5/36 266/205
7,939,012 B2 * 5/2011 Waitlevertch ..... C21B 3/04 266/228
10,132,567 B2 * 11/2018 Epps ..... F27D 3/1563

FOREIGN PATENT DOCUMENTS

KR 20060074986 * 7/2006 ..... F27D 3/1563

* cited by examiner

*Primary Examiner* — Scott R Kastler
*Assistant Examiner* — Michael Aboagye
(74) *Attorney, Agent, or Firm* — Gary K. Price

(57) ABSTRACT

A skim tool and method for removing impurities from molten alloys in furnaces generally includes a collection portion and an arm. The collection portion has an interior and a blade member having a plurality of apertures configured to capture impurities during application and direct the impurities into the interior. The skim tool further includes a conduit having a first end with an inlet and a second end having a plurality of fingers that extend in various directions along the front side of the blade member. Each of the fingers define an outlet end that are in fluid communication with the inlet. The inlet for receiving a source of nitrogen to be blown through the conduit into the molten metal in the form of a gas.

17 Claims, 8 Drawing Sheets

SKIM TOOL

CROSS REFERENCES TO RELATED APPLICATIONS

U.S. Provisional Application for Patent No. 62/520,950, filed Jun. 16, 2017, with title "Skim Tool" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates to a tool used to skim impurities floating on the top of molten alloys in furnaces.

2. Brief Description of Prior Art

In the refining process, impurities that do not vaporize are separated and float on the surface of the molten metal. When the molten metal is discharged from the furnace, the molten metal may be contaminated with such impurities/erosion products. The term "impurities" herein refers generally to materials that are sources of impure elements or non-metallic inclusions.

In order to prevent such adherence and floating substances, there is known the use of a skim boom that is used to skim material off the top of the molten alloys in furnaces, and also used to stir liquids in the furnaces and to clean the furnaces. At one end of the boom is a blade used for skimming, stirring or cleaning. The opposite end of the boom attaches to a truck for operation of the boom.

It is also known to apply flux powder in the furnace to cause the impurities floating on the surface of the molten alloys to remain on the surface longer, allowing more time for the user to skim or remove the impurities using the skim boom. However, once the impurities begin to dip or submerge in the melt, the skim boom is no longer able to access and remove or separate impurities from the molten metal. Having an increased time to access the impurities, as refining proceeds, causes the amount level of impurities in the molten metal to become very low and results in a "cleaner" melt.

As will be seen from the subsequent description, the preferred embodiments of the present invention overcome shortcomings of the prior art by (1) causing impurities immersed in the molten metal to rise to the surface, and (2) causing the impurities to stay on the surface longer in order for the user to remove.

SUMMARY OF THE INVENTION

A skim tool including a collection member attached to an arm. The collection member has an interior and a blade disposed on a front side of the collection member. The blade further defines a plurality of apertures configured to capture impurities during application and direct the impurities into the interior. The skim tool further defines a conduit having a first end with an inlet, and defining a second end that defines a plurality of fingers that extend in various directions along the front side of the collection member. Each of the fingers extending to exterior sides and a lower side of the collection member. Each of the fingers further defining an outlet end that are positioned at the sides and lower side of the collection member. Each finger's outlet end in fluid communication with the inlet.

In application, the conduit's inlet is in communication with a source of nitrogen. Thus, according to the present invention, a nitrogen source is added to or blown through the conduit into the molten metal in the form of a gas.

The Inventor has found it effective to blow a powder flux material into the molten metal with the nitrogen gas blown through the conduit. The nitrogen gas causes the impurities trapped by the flux to remain on the surface longer. The Inventor has further found that the inclusion of the nitrogen gas also causes impurities that are immersed in the molten metal to rise to the surface for collection.

DESCRIPTION OF THE PREFERRED EMBODIMENT

In accordance with the present invention, a skim tool and method for removing impurities from molten alloys in furnaces is disclosed. Specifically, the present invention provides a skim tool and method that (1) causes impurities to float to the molten metal surface, and (2) causes the impurities to stay on the surface longer. In the broadest context, the skim tool of the present invention consists of components configured and correlated with respect to each other so as to attain the desired objective.

Figure 1:
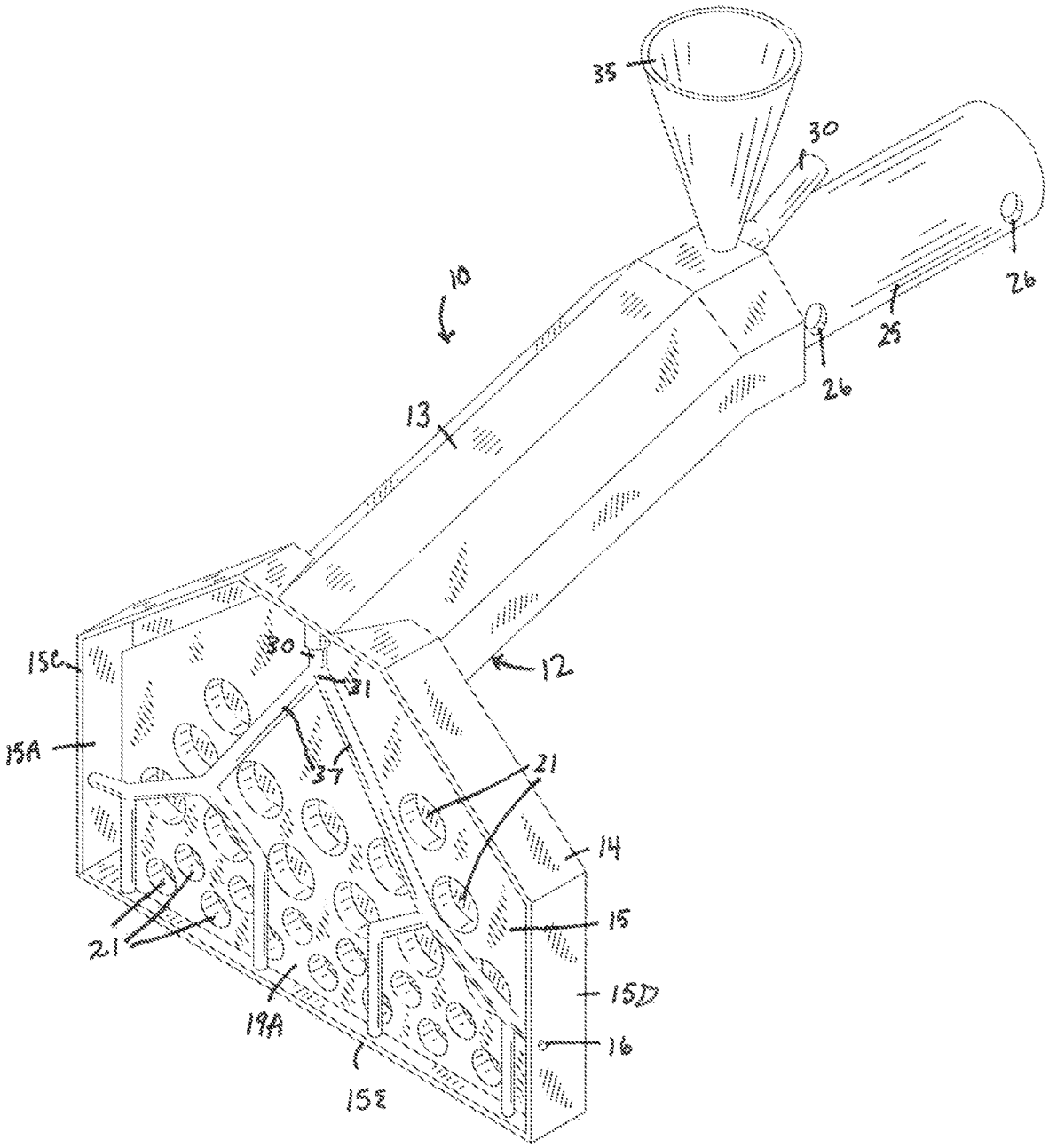
FIG. 1 is a top perspective view of a preferred embodiment of the present invention, a skim tool.
Figure 2:
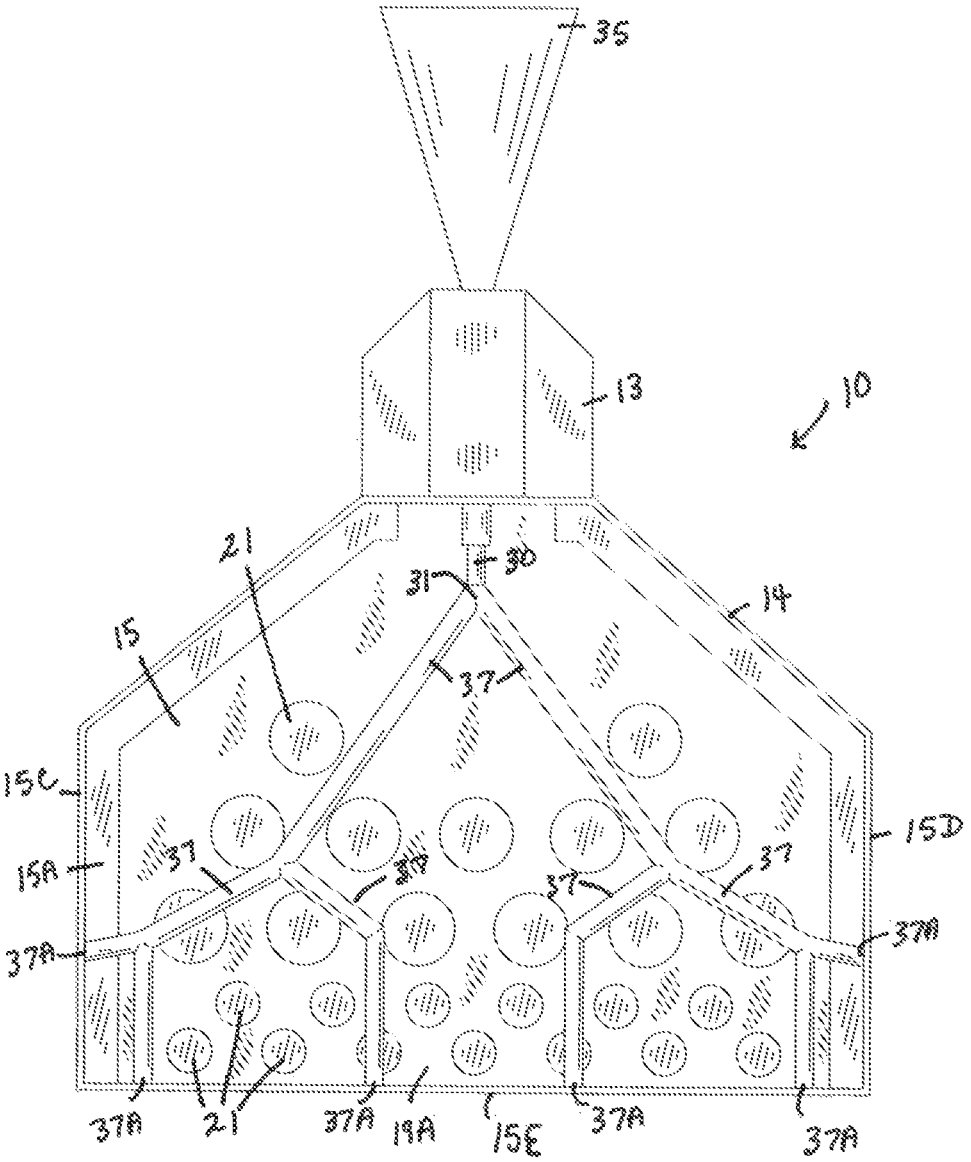
FIG. 2 is a front view of the tool of FIG. 1.
Figure 3:
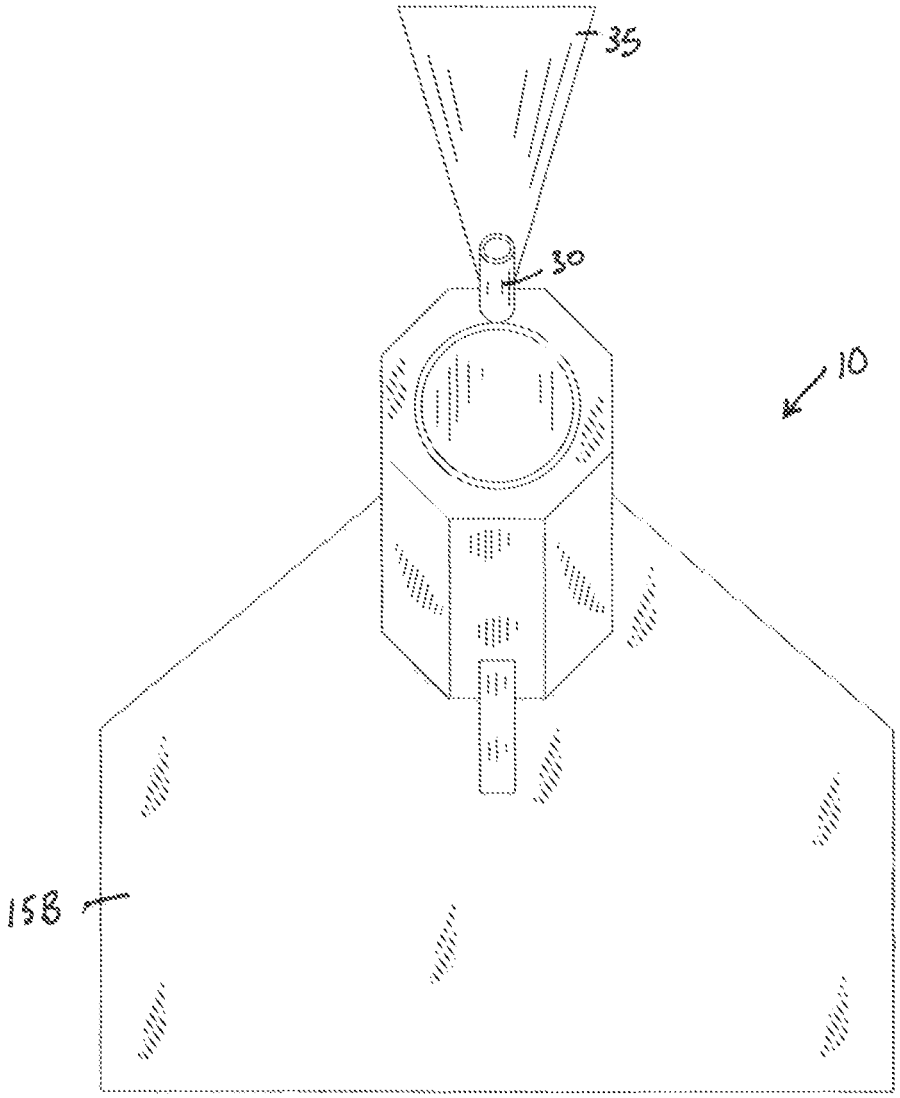
FIG. 3 is a back view of the tool of FIG. 1.
Figure 4:
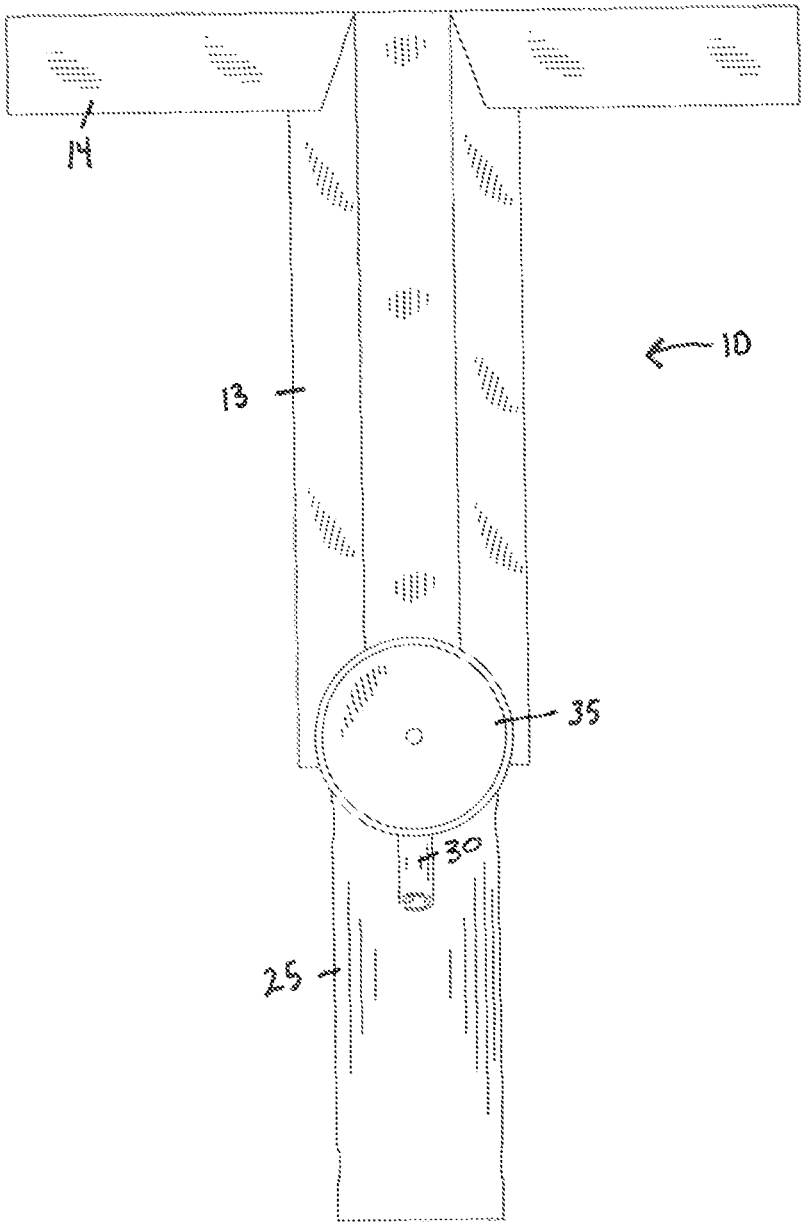
FIG. 4 is a top view of the tool of FIG. 1.
Figure 5:
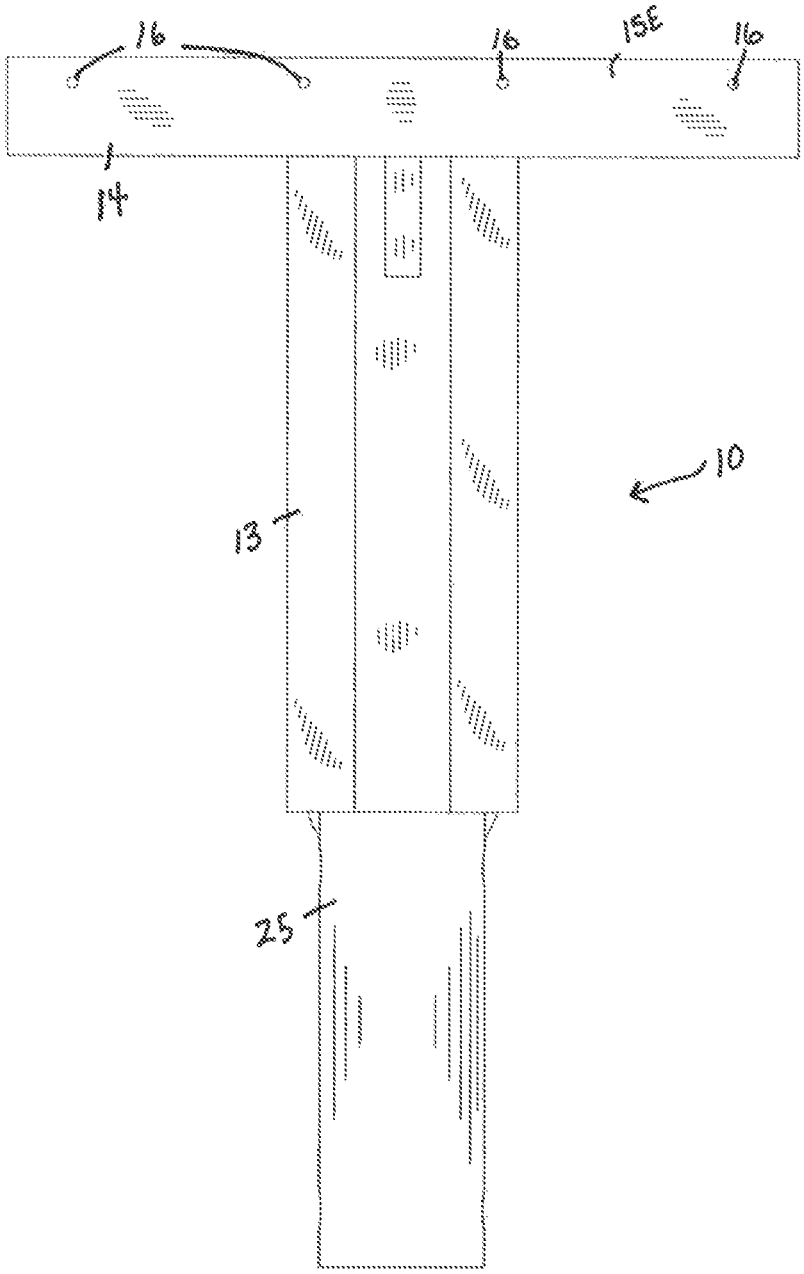
FIG. 5 is a bottom view of the tool of FIG. 1.
Figure 6:
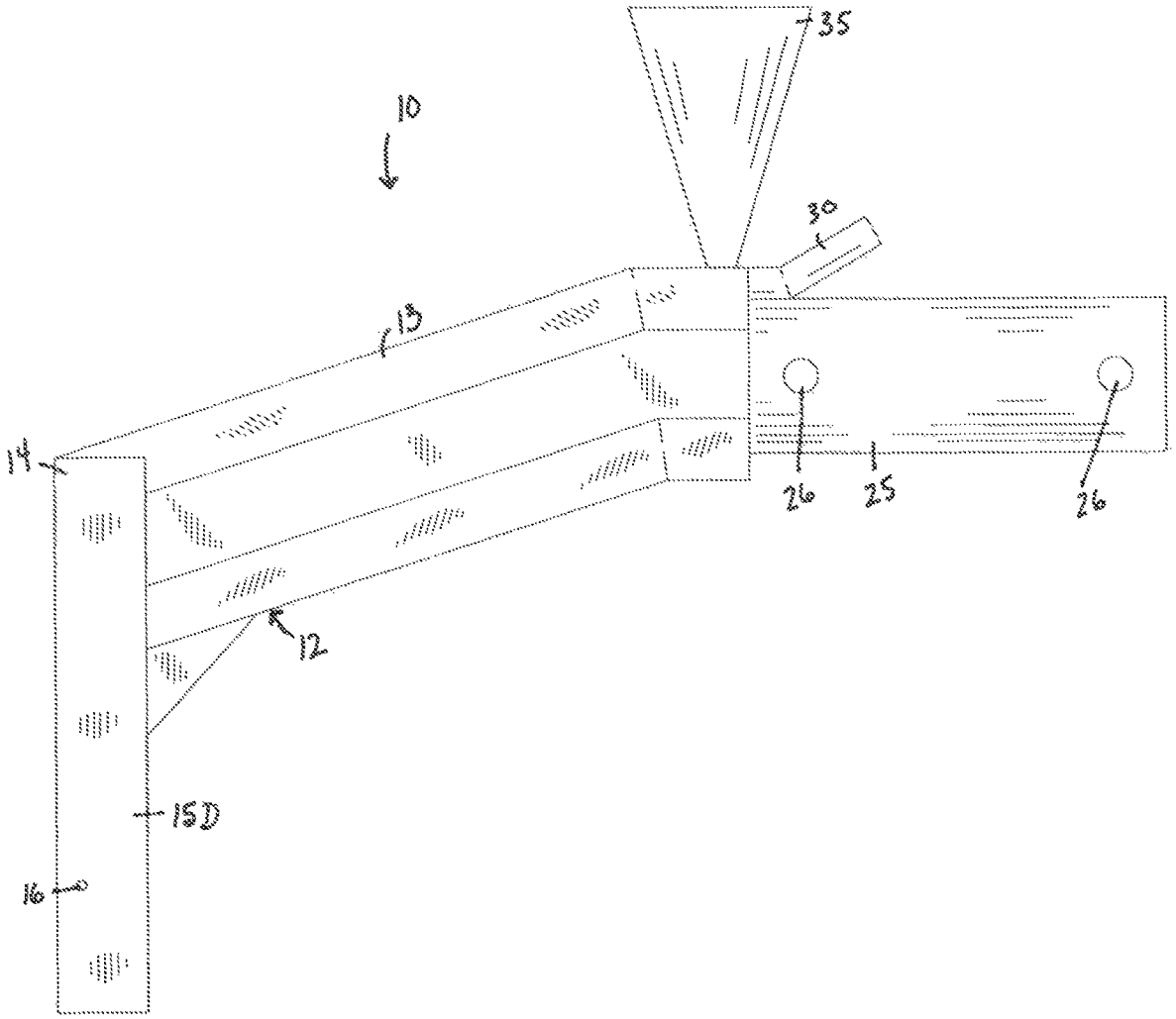
FIG. 6 is a side view of the tool of FIG. 1.
Figure 7:
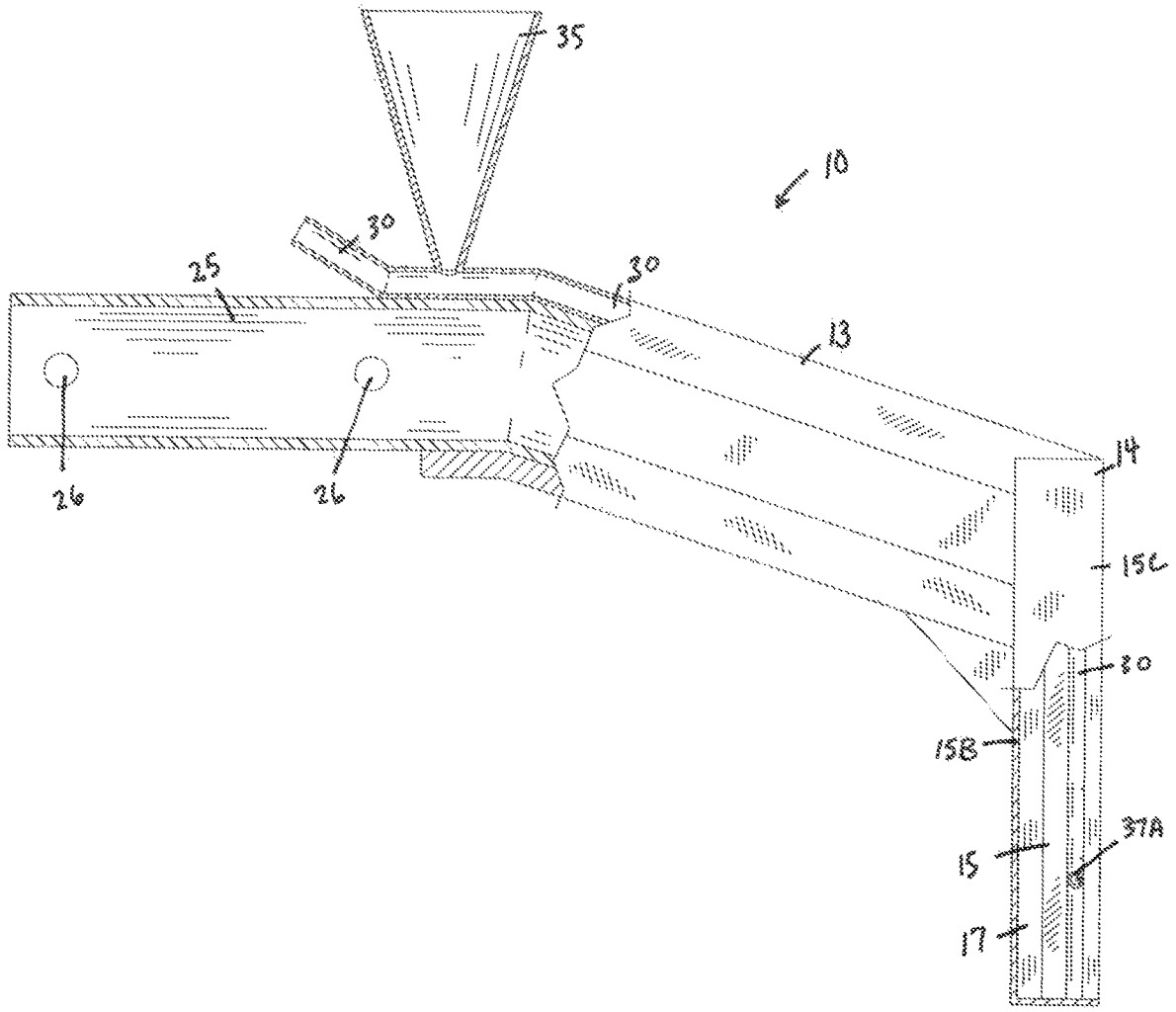
FIGS. 7 and 8 are side sectional views of the tool of FIG. 1.
Figure 8:
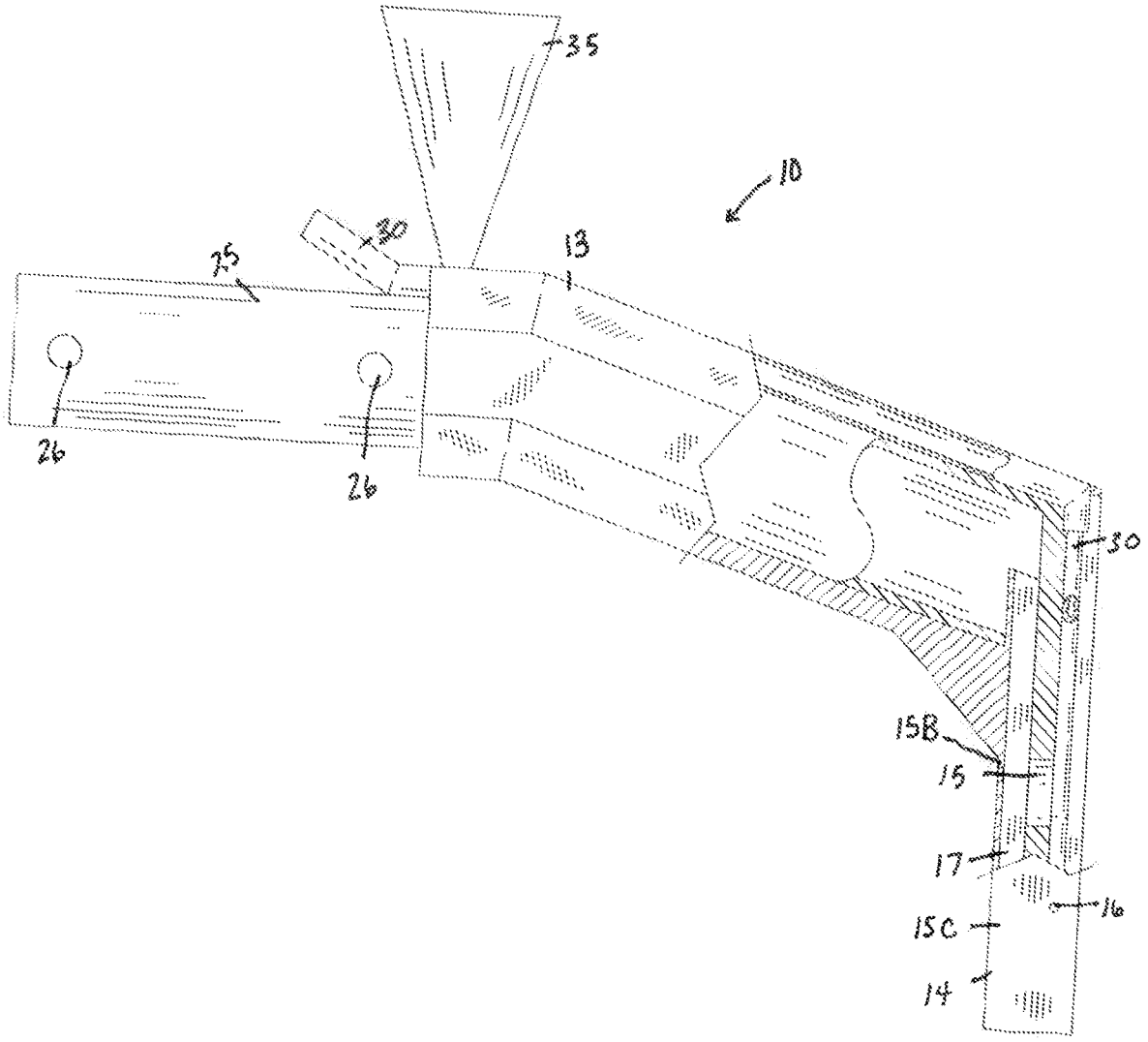

FIGS. 1-8 illustrate a preferred embodiment of a skim tool made in accordance with the present invention. The skim tool generally designated as numeral 10, includes a housing 12 that defines an extending portion 13 integral to a collection portion 14.

As illustrated, the housing 12 is a hollow structure that houses an arm 25 in communication with a collection member 15. As illustrated, the arm 25 is partially received in the extending portion 13 and includes apertures 26 configured for attaching to equipment (not shown) during application. The collection member 15 is disposed in the collection portion 14. Collection portion 14 defines an interior 17 configured for collecting the impurities during application.

The collection portion 14 defines front and back sides 15A, 15B, exterior ends 15C, 15D and lower end 15E. The collection member 15 is a blade that is disposed on the front side 15A of the collection portion 14 such that an interior 17 is formed between the blade 15 and back side 15B (see FIGS. 7 & 8) for collecting the impurities during application. The blade 15 further defines a plurality of apertures 21 configured to capture or gather impurities during application and direct the impurities into the interior 17.

The skim tool 10 further defines an extending conduit 30 that is preferably disposed on an exterior surface of the arm 25. As illustrated, the conduit 30 extends along the length of the arm 25 to the collection member 15. The conduit 30 has a first end 32 that includes an inlet 35. As illustrated, the conduit 30 further includes a shoulder 31 that defines a plurality of fingers 37 that extend in various directions along a front surface 19A of the blade 15. As illustrated, each of the fingers 37 extending to exterior sides 15C, 15D, and lower side 15E of the collection portion 14.

Each of the fingers 37 further defining an outlet end 37A that as illustrated, are in communication with the sides 15C, 15D, and 15E. In particular, the sides 15C, 15D and end 15E preferably include the same number of apertures (designated as numeral 16) as fingers 37, each aperture 16 aligned with the outlet end 37A of the fingers 37. As will be understood, each of the outlet ends 37A (and each aligned aperture 16) are in fluid communication with the inlet 35.

In application, the inlet 35 is in communication with a source of nitrogen. Thus, according to the present invention, a nitrogen source (not shown) is appropriately connected with the inlet 35 and added to or blown into the molten metal through ends 37A and apertures 16 in the form of a gas.

According to a desirable manner of the refining process, the molten metal is stirred during refining. It is effective to blow a powder flux into the molten metal in order to trap inclusions by means of the flux. In particular, the flux powder causes the inclusions or impurities to temporarily float on the molten metal surface in order to collect with the skim tool as previously discussed. Fluxes are poured into the molten metal by means known in the art.

The Inventor has found it effective to blow the powder flux material as stated into the molten metal, and to blow the nitrogen gas through the conduit 30 as described. The nitrogen gas causes the impurities trapped by the flux to remain on the surface longer. The Inventor has further found that the inclusion of the nitrogen gas also causes impurities that are immersed in the molten metal to rise to the surface for collection.

As illustrated, in the preferred embodiment, the nitrogen passes through the inlet and is added or blown into the molten metal through the outlet ends 37A of the plurality of fingers 37. As illustrated, the inventor has found that at least one outlet end 37A is preferably disposed on each side 15C, 15D of the collection member 15, and preferably four (4) evenly spaced outlet ends 37A discharge the nitrogen gas from the lower side 15E.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. A skim tool comprising:

a housing having an extending portion and a collection portion, wherein said housing is a hollow structure that houses an arm and a collection member, and wherein said arm is disposed in the extending portion and said collection member is disposed in the collection portion, and wherein said collection portion defines an interior configured for collecting impurities during application, said collection portion defines a front side and a back sides, exterior ends and a lower end, and wherein said collection member is disposed on the front side of the collection portion such that said interior is formed between the collection member and said back side, and wherein said collection member defines a plurality of apertures configured to capture or gather impurities during application and direct the impurities into said interior, an extending conduit is positioned on an exterior surface of said arm, said conduit extends along the length of the arm and has a first end that includes an inlet, and a second end having a plurality of fingers that extend in various directions along the front side of said collection member, and wherein each of said plurality of fingers extending to said exterior ends and said lower side of the collection portion.

2. The skim tool of claim 1, wherein each of said plurality of fingers further define an outlet end that are in fluid communications with said inlet.

3. The skim tool of claim 2, wherein said exterior ends and said lower side including a number of apertures, and wherein said number of apertures equal the number of outlet ends.

4. The skim tool of claim 3, wherein each said aperture is aligned with said outlet end.

5. The skim tool of claim 4, wherein said inlet is in communication with a source of nitrogen such that a nitrogen gas from the nitrogen source passes through the conduit and out through said outlet ends and said apertures.

6. The skim tool of claim 5, wherein said collection member is a blade.

7. A skim tool comprising:

a housing having an extending portion and a collection portion, wherein said housing is a hollow structure that houses an arm and a collection member, and wherein said arm is disposed in the extending portion and said collection member is disposed in the collection portion, and wherein said collection portion defines an interior configured for collecting impurities during application, said collection portion defines a front side and a back sides, exterior ends and a lower end, and wherein said collection member is disposed on the front side of the collection portion such that said interior is formed between the collection member and said back side, and wherein said collection member defines a plurality of apertures configured to capture or gather impurities during application and direct the impurities into said interior, a conduit having a first end having an inlet and said conduit including a location where said conduit defines a plurality of fingers that extend in various directions, each of said plurality of fingers extending from said location to said exterior ends and said lower side, each of said plurality of fingers further defining an outlet end, and wherein said inlet is in fluid communication with a source of nitrogen and wherein said inlet is in fluid communications with the outlet end of each of said plurality of fingers.

8. The skim tool of claim 7, wherein said exterior ends and said lower side including a number of apertures, and wherein said plurality of fingers including a number of outlet ends, and wherein said number of apertures equal the number of outlet ends.

9. The skim tool of claim 8, wherein each said aperture is aligned with the outlet end of one of said plurality of fingers.

10. The skim tool of claim 9, wherein the outlet end of at least one of said plurality of fingers is disposed on each exterior end of the collection portion.

11. The skim tool of claim 10, wherein the outlet end of at least one of said plurality of fingers is disposed on said lower side of the collection portion.

12. The skim tool of claim 7, wherein said collection member is a blade.

13. A skim tool comprising:

an arm that is in communication with a collection portion, said collection portion defines a back side, exterior ends and a lower end, and a blade member disposed in said collection portion such that an interior is formed between said blade and said back side, and wherein said blade defines a plurality of apertures configured to capture or gather impurities during application and direct the impurities into said interior, a conduit having a first end having an inlet and said conduit defining a location where said conduit defines a plurality of fingers, each of said plurality of fingers extending from said location to said exterior ends and said lower side, each of said plurality of fingers further defining an outlet end, and wherein said inlet is in fluid communication with the outlet end of each of said plurality of fingers.

14. The skim tool of claim 13, wherein said exterior ends and said lower side include a number of apertures.

15. The skim tool of claim 14, wherein each aperture of said number of apertures is aligned with the outlet end of one of said plurality of fingers.

16. The skim tool of claim 15, wherein the outlet end of at least one of said plurality of fingers is disposed on each exterior end of the collection portion.

17. The skim tool of claim 16, wherein the outlet end of at least one of said plurality of fingers is disposed on said lower side of the collection portion.

* * * * *